US007409900B1

(12) United States Patent
Nechitailo et al.

(10) Patent No.: US 7,409,900 B1
(45) Date of Patent: Aug. 12, 2008

(54) RAILS FOR ELECTROMAGNETIC HYPERVELOCITY LAUNCHER

(75) Inventors: Nicholas V. Nechitailo, King George, VA (US); Keith B. Lewis, King George, VA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 180 days.

(21) Appl. No.: 11/602,438

(22) Filed: Nov. 2, 2006

(51) Int. Cl.
*F41B 6/00* (2006.01)
*F41F 1/00* (2006.01)

(52) U.S. Cl. ..... 89/8; 124/3

(58) Field of Classification Search ..... 89/8; 124/3

See application file for complete search history.

(56) References Cited

U.S. PATENT DOCUMENTS

| | | | | | |
|---|---|---|---|---|---|
| 3,126,789 | A | * | 3/1964 | Meyer | 89/8 |
| 4,485,720 | A | * | 12/1984 | Kemeny | 89/8 |
| 4,608,908 | A | * | 9/1986 | Carlson et al. | 89/8 |
| 4,641,567 | A | | 2/1987 | Creedon | 89/8 |
| 4,870,888 | A | * | 10/1989 | Weldon et al. | 89/8 |
| 5,076,135 | A | * | 12/1991 | Hurn et al. | 89/8 |
| 5,078,042 | A | * | 1/1992 | Jensen | 89/8 |
| 5,133,241 | A | | 7/1992 | Koyama et al. | 73/28.04 |
| 5,133,242 | A | | 7/1992 | Witt | 55/76 |
| 5,183,957 | A | * | 2/1993 | Weldon et al. | 89/8 |
| 5,237,904 | A | * | 8/1993 | Kuhlmann-Wilsdorf | 89/8 |

(Continued)

OTHER PUBLICATIONS

N. V. Nechitailo et al., "Critical Velocity For Rails in Hypervelocity Launchers", *Int'l J. of Impact Engineering*, not yet published.

(Continued)

*Primary Examiner*—Bret Hayes
(74) *Attorney, Agent, or Firm*—Gerhard W. Thielman Esq.

(57) ABSTRACT

An electromagnetic launcher is provided for accelerating a projectile from a breech end to a muzzle end. The launcher includes a container, a rail contained therein and a support. The container includes an inner surface along an axial direction. The rail is contained within the inner surface and includes a load surface to support the projectile and an interface surface. The support is disposed between the interface surface and the inner surface. The rail and the support provide a value to an expression for critical velocity $$V_{cr} = \sqrt{\frac{2\sqrt{EIk}}{\rho A}},$$

where E is Young's modulus for the rail, I is moment of inertia for the rail, k is foundation modulus for the support, ρ is density for the rail and A is the cross-sectional area of the rail. The launcher is configured such that the critical velocity increases along the axial direction towards the muzzle. In particular, a material term √E/ρ of the rail increases along the axial direction, such for the rail being made from a first material being proximate to the breech and a second material being proximate to the muzzle, such that the material term √E/ρ of the second material being greater than that of the first material. Alternatively, the rail is made into a first shape being proximate to the breech and a second shape being proximate to the muzzle, such that a shape term √I/A of the second shape is greater than that of the first shape.

15 Claims, 3 Drawing Sheets

U.S. PATENT DOCUMENTS

| | | | | | |
|---|---|---|---|---|---|
| 5,275,083 | A | * | 1/1994 | Hawke et al. | 89/8 |
| 5,285,763 | A | * | 2/1994 | Igenbergs | 124/3 |
| 5,297,468 | A | * | 3/1994 | Dreizin | 89/8 |
| 5,417,140 | A | * | 5/1995 | Onozuka et al. | 89/8 |
| 5,431,083 | A | | 7/1995 | Vassioukevich | 73/863.23 |
| 5,454,289 | A | * | 10/1995 | Bacon et al. | 89/8 |
| 5,483,863 | A | * | 1/1996 | Dreizin | 89/8 |
| 7,077,046 | B2 | * | 7/2006 | Nelyubin | 89/8 |
| 7,077,047 | B2 | * | 7/2006 | Frasca | 89/8 |
| 2006/0011055 | A1 | | 1/2006 | Root, Jr. | 89/1.819 |

OTHER PUBLICATIONS

K. Daneshjoo et al., "Dynamic Response and Armature Critical Velocity Studies in an Electromagnetic Rail Gun", IEEE 13th EML Symposium, May 23, 2006, Potsdam, Brandenburg, Federal Republic of Germany, paper 153.

A. J. Johnson et al., "Elastic Waves in Electromagnetic Launchers", IEEE 13th EML Symposium, May 23, 2006, paper 25.

J. T. Tzeng, "Structural Mechanics for Electromagnetic Rail Guns", IEEE EML 2004, pp. 127-132.

* cited by examiner

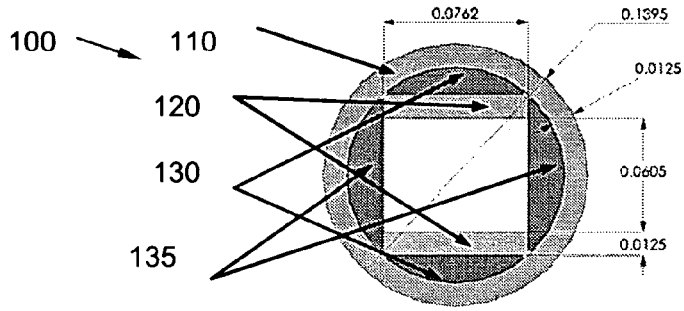
FIG. 1
FIG. 2
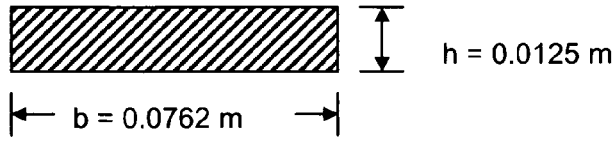
FIG. 3
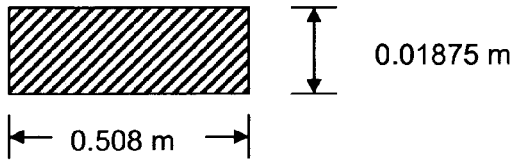
FIG. 4
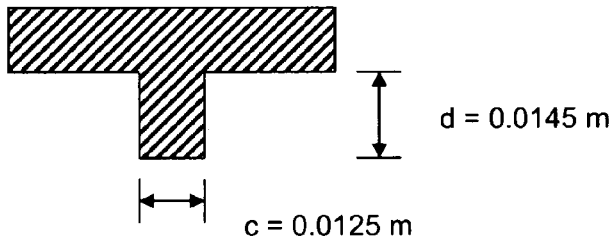
FIG. 5
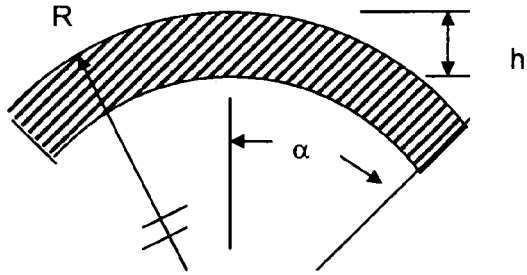

RAILS FOR ELECTROMAGNETIC HYPERVELOCITY LAUNCHER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to electromagnetic launcher rails, and more particularly to such methods and configurations that preferably can improve durability and performance of rails for launching a projectile at high speed.

An electromagnetic launcher utilizes electromagnetic force to propel an electrically conductive payload. Electrically conductive rails may be disposed in a longitudinal launch direction from breech to muzzle ends. Electric current flowing through the rails induces a magnetic field. This field produces a mutual repulsion force between the rails and accelerates the payload along at least one of the rails.

An armature pushes the projectile for release through the muzzle. Physical and design constraints present limitations as to launch speeds and rail ability to perform after firing multiple loads without failure.

SUMMARY

Conventional rails yield disadvantages addressed by various exemplary embodiments of the present invention. In contrast, various exemplary embodiments introduce a family of geometric and material configurations for an electromagnetic launcher to provide increased critical velocity, preferably above the launch speed for a given launcher. Consequently, the launcher rails may operate below damaging resonant regimes. The operational life of the rails and launcher may be significantly extended thereby.

In particular, the electromagnetic launcher provided for accelerating a projectile from an initial speed at a breech end to a launch speed at a muzzle end includes a containment tube, a rail contained therein and a support. The tube may include an inner concave surface (or annulus) along an axial direction. The rail is contained within the inner concave surface and includes an inside load surface to support the projectile and an outer interface surface. The support may be disposed between the interface surface and the inner concave surface to provide an electrically insulating structural buffer between the rail and the tube.

Physical and material characteristics of the rail and the support may limit the practical maximum speed, called "critical velocity" at which a load may travel therealong. Critical velocity may be expressed as $$V_{cr} = \sqrt{\frac{2\sqrt{EIk}}{\rho A}},$$

where E is Young's modulus for the rail, I is moment of inertia for the rail, k is elastic modulus for the insulating support, ρ is density for the rail and A is the cross-sectional area of the rail. The critical velocity increases along the axial direction towards the muzzle and continuously exceeds the projectile's speed accelerating between the initial speed at the breech and the launch speed at the muzzle.

Various exemplary embodiments provide for launcher configurations having values of critical velocities that exceed operational launch velocities of the projectiles. This principle may be implemented using design for critical velocity increasing along the axial direction towards the muzzle. For example, a material term $\sqrt{E/\rho}$ of the rail increases along the axial direction, such for the rail being made from a first material being proximate to the breech and a second material being proximate to the muzzle, such that the material term $\sqrt{E/\rho}$ of the second material being greater than of the first material. Alternatively or additionally, the rail may be formed into a first shape being proximate to the breech and a second shape being proximate to the muzzle, such that a shape term $\sqrt{I/A}$ of the second shape is greater than of the first shape.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 1 is a cross-sectional view of a launcher tube with rails;

FIG. 2 is a first cross-sectional view of a rail;

FIG. 3 is a second cross-sectional view of a rail;

FIG. 4 is a third cross-sectional view of a rail;

FIG. 5 is a fourth cross-sectional view of a rail;

DETAILED DESCRIPTION

Figure 6:
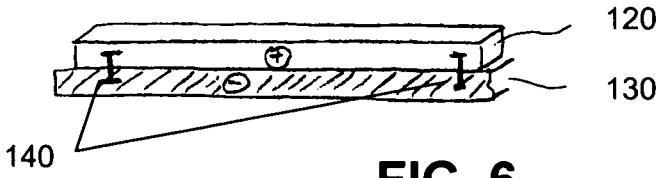
FIG. 6 is an isometric view of a rail connected to a support.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In railroad and rocket sled technologies, tracks that support rapidly moving loads may experience resonance-induced deflections. Such conditions may occur in response to load transport that approaches an effective "critical velocity" causing derailment and/or track fracture. Further details of this phenomenon are described in "Critical Velocity for Rails in Hypervelocity Launchers" by N. V. Nechitailo and K. B. Lewis, *International Journal of Impact Engineering*, expected to be published in late 2006 and incorporated herein by reference in its entirety.

A launcher may use gas pressure or magnetic force to accelerate a projectile between the breech and the muzzle. If the projectile speed rises to approach critical velocity, the stresses and responding strains may increase significantly to yield displacements that cause premature wear and structural damage, thereby shortening the useful life of the launcher system and its components.

The buckling of slender beams can be characterized by critical velocity, described further herein. A structural member having longitudinal length orders of magnitude greater than lateral and transverse dimensions may be characterized as a long slender beam. Commonly used beam models include the Bernoulli-Euler beam and the Timoshenko beam.

A Bernoulli-Euler beam supported on a continuous elastic foundation may respond to a concentrated transverse load moving along the beam similarly to the beam response to a longitudinal compressive force. The beam exhibits buckling with significant transverse displacements and bending moments. A Timoshenko beam includes shear stresses and rotational inertia effects on the beam deformation.

A projectile launched along rails may be modeled as a concentrated load moving along a beam's length. A transverse deflection may be characterized by displacement w according to the following relation:

$$EI\frac{\partial^4 w}{\partial x^4} + \rho A\frac{\partial^2 w}{\partial t^2} + kw = 0, \quad (1)$$

where displacement w is a function of the longitudinal direction x and time t, E is Young's modulus of elasticity, I is the moment of inertia of the rail's cross-section, ρ is the rail's mass density, A is the rail's cross-sectional area and k is a spring constant representing modulus of elastic foundation.

The mass term ρA can also be expressed as q/g for q as the weight of rail per unit length and g as gravitational acceleration. The foundation modulus k is analogous to the bulk (compressive) modulus for the substrate material that supports the rail. (See Timoshenko S., "Method of Analysis of Statical and Dynamic Stresses in Rail", *Proc. 2nd Int. Congress of Applied Mechanics*, Zurich, ©1927, pp. 1-12.) The bulk modulus $B=E(3-6\mu)^{-1}$, where μ is Poisson's Ratio.

Timoshenko compared the influence of load speed on the magnitude of rail deflection to an additional compressive force S as:

$$S=\rho AV^2. \quad (2)$$

Buckling may occur when the critical value of compressive force $S_{cr}$ satisfies the relation:

$$S_{cr}=2\sqrt{EIk}. \quad (3)$$

Substituting for compressive force, S, the critical velocity $V_{cr}$ can be approximately solved as:

$$V_{cr} = \sqrt{\frac{2\sqrt{EIk}}{\rho A}}. \quad (4)$$

A cross-section of an exemplary launcher 100 is shown in FIG. 1. The launcher 100 may include a tubular containment shell (i.e., tube or container) 110 made of steel having an inner concave surface into which are disposed top and bottom rails 120 made of aluminum. The cross-section of the tube 110 may be circular or noncircular, and further may comprise one or more elements. Each rail 120 may include an inside load surface and an outer tube-facing surface.

Gaps 130 (or a sleeve) between the rails (specifically its tube-facing surface) and the tube 110 may be filled with an electrical insulator, such as G-10 fiberglass. The gap serves to physically separate the rails 120 and the tube 110 for preventing electrical conduction therebetween that would cause a short circuit. Hence, the material contained within the gap 130 may serve as an electrical insulator. Similar adjacent spaces 135 may also be disposed inside the tube 110 laterally from the rails 120 and filled with the fiberglass.

In the configuration shown, each rail 120 possesses a rectangular cross-section. The projectile and armature (together representing a payload to be accelerated) travel along the launcher 100 against the inside load surfaces of the rails 120. For a rectangular cross-section, the moment of inertia of each rail 120 is $I=bh^3/12$, with the corresponding cross-sectional area being A=bh.

Example dimensions for the rectangular cross-section include rail base width of b=0.0762 m (3 in) and rail thickness height h=0.0125 m (~0.5 in). The resulting moment of inertia and area are $I=1.240\times10^{-8}$ m$^4$ and $A=9.525\times10^{-4}$ m$^2$, respectively. This wide rectangular cross-section is shown in FIG. 2.

The relevant material characteristics include for the aluminum rail Young's modulus E=69 GPa and density ρ=2750 kg/m$^3$. (Recall that a pascal equals one Newton per square meter, and the "giga-" prefix represents thousand-million.) The fiberglass support provides a value for foundation modulus k=4.72 GPa. From these values, the critical velocity is $V_{cr}$=1.239 km/s.

Upon launch, the projectile accelerates along the rails of the electromagnetic launcher. The projectile's speed increase may cause that speed to approach the critical velocity $V_{cr}$ determined for the portion of track being loaded by the projectile. Thus, to avoid localized rail buckling, various exemplary embodiments provide for the critical velocity to increase accordingly along the launcher length from the breech to the muzzle. In order to concurrently facilitate operation and maintenance, exemplary embodiments provide for segments of the rail that exhibit differing material or geometric characteristics.

Critical velocity may be increased by replacing the rail material and/or the rail cross-section and/or replacing the support material. In particular, a material term $\sqrt{E/\rho}$ of the rail may be selected to increase along the axial direction. Alternatively or additionally, a shape term $\sqrt{I/A}$ that characterizes the rail shape may be selected to increase along the axial direction.

As an alternate example, aluminum may be replaced by steel as the rail material for the original rectangular cross-section. (This material change may structurally strengthen the rail, but exhibit reduced electrical conduction properties.) For cast steel, Young's modulus E=197 GPa and density ρ=7830 kg/m$^3$. Although the modulus of elasticity increases by a factor of 2.86, the effect on critical velocity serves as a multiplier of only 1.30, while the density increases by a factor of 2.85 and serves as a divisor of 1.69. Consequently, this material change from aluminum to steel reduces the critical velocity $V_{cr}$ to 0.955 km/s. The multiplier represents a ratio of $\{(E^{0.5}/\rho)_{replacement\ material}/(E^{0.5}/\rho)_{aluminum}\}^{0.5}$.

Similarly, titanium has properties of Young's modulus E=116 GPa and density ρ=4507 kg/m$^3$, yielding a decrease in critical velocity to 1.102 km/s. Also similarly, copper has properties of Young's modulus E=130 GPa and density ρ=8920 kg/m$^3$, yielding a decrease in the critical velocity to 0.806 km/s.

In contrast, a material change to a light-weight material having high strength, such as beryllium yields properties of Young's modulus E=287 GPa and density ρ=1846 kg/m$^3$, increasing the critical velocity to 2.160 km/s for an increase of 74.3 percent. Alternatively, employment of a non-metal such as carbon with Young's modulus E≈200 GPa and density ρ≈1570 kg/m$^3$, yields an increase in the critical velocity to 2.139 km/s for an increase of 72.6 percent.

Other candidate materials for consideration include silicon carbide having Young's modulus E=450 GPa and density ρ≈3200 kg/m$^3$, and beryllium oxide having Young's modulus E=380 GPa and density ρ≈2850 kg/m$^3$. These material substitutions increase the critical velocity $V_{cr}$=1.649 km/s for silicon carbide and 1.505 km/s for beryllium oxide. These represent critical velocity increases over aluminum rails of between of 33.1 and 21.4 percent, respectively. Designs using these ceramics may necessitate incorporation of an electrically conductive material in a portion of the rail cross-section to provide electrical connection along the launcher 100.

As a second alternate example, fiberglass may be replaced by ceramic as the support material. The ceramic support provides an estimated value for foundation modulus k≈154 GPa. For the previously described flat aluminum rail cross-section and ceramic support, the corresponding critical velocity would be $V_c$=2.961 km/s for an increase of 139 percent. Carbon fiber represents lighter substitute support material with an estimated foundation modulus of k≈120 GPa. For the previously described flat aluminum rail cross-section and graphite support, the corresponding critical velocity would be $V_{cr}$=2.782 km/s for an increase of 125 percent. Although carbon is somewhat more conductive than most ceramics, an electrically insulative material may be interposed between the support 130 and the rail 120.

As a third alternate example, the rail cross-section geometry may be altered to increase height and reduce the base width for the same cross-sectional area. This second cross-section is shown in FIG. 3. For the height multiplied by a factor of 1.5, and the base divided the same factor, the cross-sectional area would remain the same. Nonetheless, the corresponding moment of inertia yields I=2.791×10$^{-8}$ m$^4$. This geometry change produces a corresponding critical velocity $V_{cr}$=1.517 km/s for an increase of 22.5 percent.

As a fourth alternate example, the rail cross-section geometry of FIG. 1 may be altered from a rectangle to a T-beam cross-section, with a stem extending from the base midline to the tube wall. This third cross-section is shown in FIG. 4 with the stem thickness c=0.0125 m and the stem length d=0.145 m. The cross-sectional area increases to A=bh+cd=1.134×10$^{-3}$ m$^2$. The T-beam moment of inertia is calculated by the relations:

$$I = \frac{bh^3 + cd^3}{12} + bh\left(d + \frac{h}{2} - \bar{y}\right)^2 + cd\left(\frac{d}{2} - \bar{y}\right)^2, \text{ where} \tag{6}$$

$$\bar{y} = \frac{\frac{cd^2 + bh^2}{2} + bhd}{bh + cd}. \tag{7}$$

(See David Royland, "Stresses in Beams", November 2000 at http://web.mit.edu/-course/3/3.11/www/modules/bstress.pdf.) From these T-beam relations, the moment of inertia I=4.33×10$^{-8}$ m$^4$. This geometry change produces a corresponding critical velocity $V_{cr}$=1.553 km/s for an increase of 25.3 percent.

As a fifth alternate example, the rail cross-section geometry may be altered from a rectangle to a concave arc segment of a hollow circle. This fourth cylindrical cross-section is shown in FIG. 5, with R representing the radius of curvature, h representing thickness and α being the half angle or arc. That corresponding moment of inertia can be reasonably be approximated by the relation:

$$I = Rh^3\left[1 - \frac{3h}{2R} + \ldots\right]\left(\alpha + \sin\alpha\cos\alpha - \frac{2\sin^2\alpha}{\alpha}\right) + \ldots, \tag{8}$$

with ellipses representing higher order terms. (See Raymond J. Roarke and Warren C. Young, *Formulas for Stress and Strain* 5/e, ©1995, McGraw-Hill, formula 19, p. 69, corrected and approximated) The area for this corresponding cross-section can be expressed as A=π(2Rh−h$^2$)/12. For half-angle α=15° (or π/12) and h=0.0125 m, a span of 0.0762 m corresponds to R=0.147 m (or 5.8 in). The resulting moment of inertia is I=9.614×10$^{-8}$ m$^4$. This geometry change produces a critical velocity $V_{cr}$=2.102 km/s for an increase of 69.6 percent.

Another modification of the rail may be performed by pre-loading the rail in tension, as shown in FIG. 6. This process may pre-stretch and rigidly connect the rail 120 at attach locations 140 near its end points (as shown) or at select intervals to a containment or support member 130 pre-loaded in compression. As a pre-tensioned beam, the connected rail 120 may buckle under higher moving compressive loads than absent pre-tension, thereby reducing rail-buckling effects in the launcher.

Figure 7:
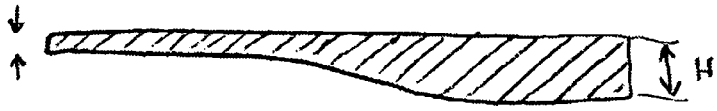
FIG. 7 is an elevation view of a rail having variable thickness.

Yet another modification of the rail may be made by altering the thickness of the rail 120 along its length. FIG. 7 shows an elevation view of a rail having a thin portion with a first height (or thickness) h towards the breech and a thick portion with a second height (or thickness) H towards the muzzle. Such an alteration in shape may be accompanied by continuous change along the segment axial length. Alternatively, individual segments concatenated together may have uniform cross-section, and instead vary shape to affect moment of inertia segment by segment. These connected segments may preferably enable electrical conductivity between them for launch operation.

Artisans of ordinary skill will also recognize that combinations and/or modifications of these material selections and geometries may be employed along portions of the rail to increase critical velocity, without departing from the scope of the inventive concepts.

Figure 8:
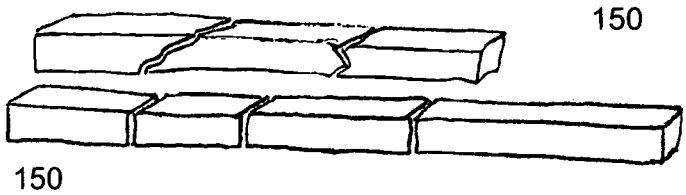
FIG. 8 is an isometric view of a segmented rail.

Various exemplary embodiments may vary material properties and/or geometric characteristics as separate individual segments 150 for portions of the rail 120, as shown in FIG. 8. These segments 150 may have uniform cross-section, or vary shape to affect moment of inertia segment by segment.

Figure 9:
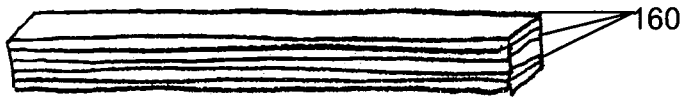
FIG. 9 is an isometric view of a laminated rail.

As a sixth alternate example, the rails may form several layers 160 of different and/or alternating materials in a lamination, as shown in FIG. 9. In particular, some of the layers may possess high damping properties. The rail materials may preferably incorporate materials having high electrical conductivity along the longitudinal direction (over at least a portion of the cross-section) to carry current for launch purposes.

Figure 10:
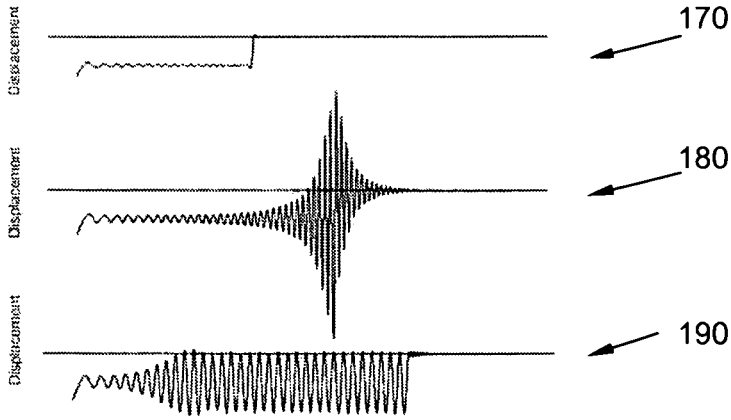
FIG. 10 is a set of plots showing displacement from a moving load.

FIG. 10 illustrates three graphs of a rail segment and a moving semi-infinite load. An upper displacement plot 170 corresponds to the load traveling at below the critical velocity, a middle displacement plot 180 corresponds to the load moving at the critical velocity (in this example at 1.2 km/s), and a lower displacement plot 190 corresponds to the load moving at above the critical velocity.

The upper plot 170 exhibits a displacement having small-amplitude oscillations as the load travels along the rail, representing a desirable outcome. The middle plot 180 shows sharply increasing amplitude, which may cause structural failure of the rail 120. The lower plot 190 represents steady-undamped oscillations that may detrimentally affect the rail's useful life by fatigue.

Figure 11:
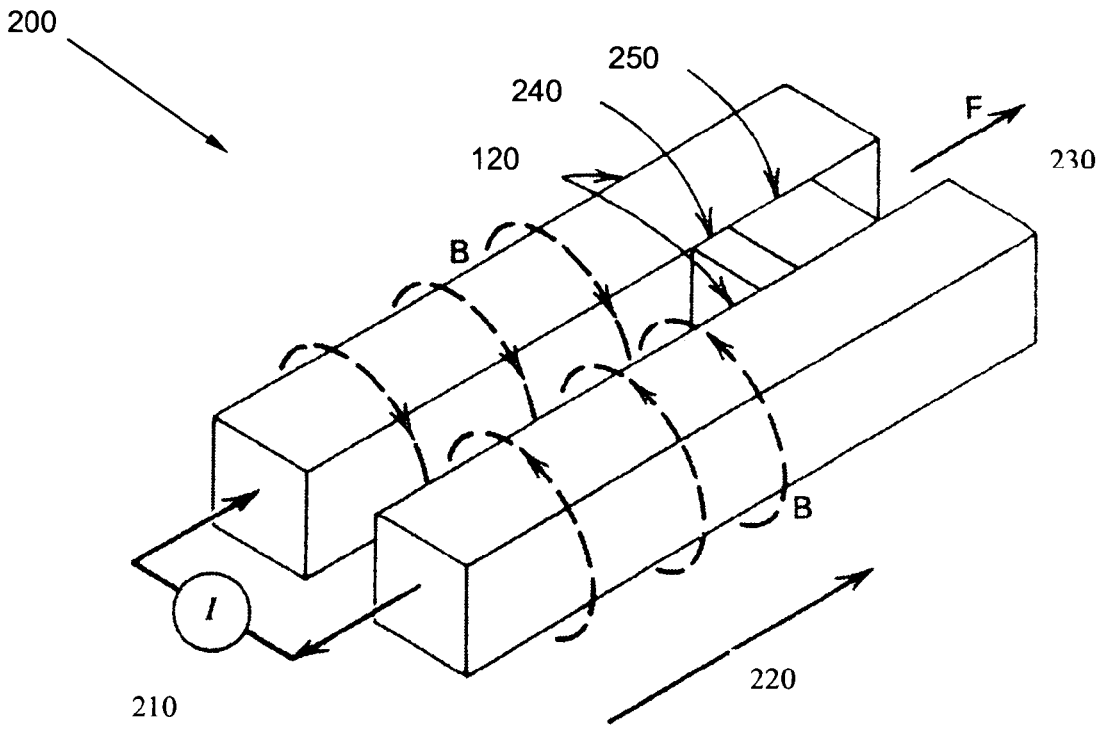
FIG. 11 is an isometric view of the rails.

The electromagnetic rail gun may be isometrically visualized in FIG. 11 within context of a generalized configuration 200 of the rails 120. Current I travels from an electrical source 210 along the rails 120 in the longitudinal direction 220. This induces a magnetic field B around the rails 120 that produces a mutual repulsive force F 230 to accelerate the armature 240 in the longitudinal direction 220. The armature 240 pushes the projectile 250 to be propelled out of the launcher 100.

Figure 12:
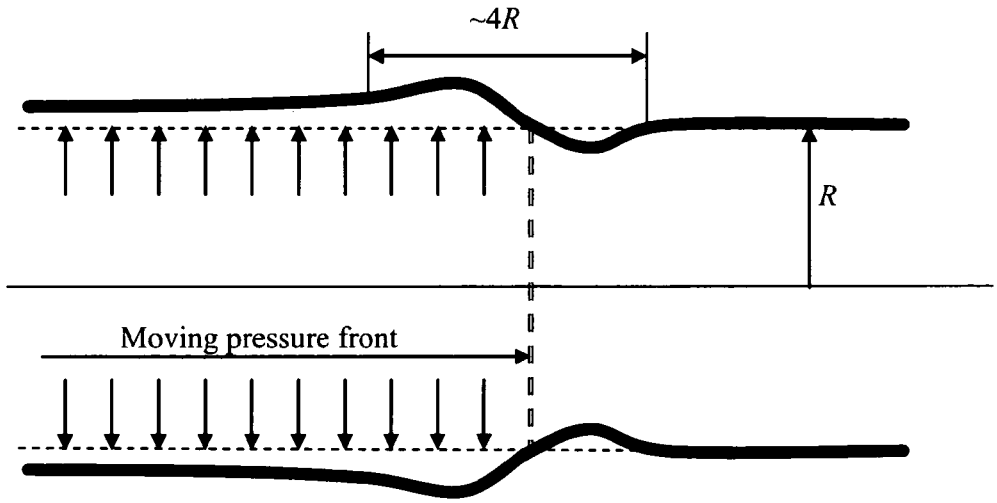
FIG. 12 is an elevation view of a gun barrel in deformation.

FIG. 12 illustrates an elevation view of a gun barrel of radius R with a moving pressure front at the critical speed. The front is shown as a thick dash line. The barrel downstream of the front has expanded from beyond the initial radius R shown by thin dash lines. A radial deflation and inflation deformation region extends about 4×R along the direction of travel and envelopes the front.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An electromagnetic launcher for accelerating a projectile from an initial speed at a breech end to a launch speed at a muzzle end, the launcher comprising:

a container having an inner surface along an axial direction;

a rail contained within the inner surface, the rail having a load surface to support the projectile and an interface surface; and a support between the interface surface and the inner surface, wherein the rail and the support provide a value to an expression for critical velocity $$V_{cr} = \sqrt{\frac{2\sqrt{EIk}}{\rho A}},$$

where E is Young's modulus for the rail, I is moment of inertia for a cross-section of the rail, k is foundation modulus for the support, ρ is density for the rail and A is a cross-sectional area of the rail, the critical velocity increases along the axial direction towards the muzzle; and the critical velocity continuously exceeds an accelerating speed of the projectile between the initial speed at the breech end and the launch speed at the muzzle end.

2. The electromagnetic launcher according to claim 1, wherein a material term $\sqrt{E/\rho}$ of the rail increases along the axial direction.

3. The electromagnetic launcher according to claim 2, wherein the rail comprises first and second materials, the first material being proximate to the breech, the second material being proximate to the muzzle, and the material term $\sqrt{E/\rho}$ of the second material is greater than of the first material.

4. The electromagnetic launcher according to claim 3, wherein the first material is aluminum and the second material is one of beryllium, beryllium oxide and silicon carbide.

5. The electromagnetic launcher according to claim 3, wherein the rail comprises first and second portions, the first material being proximate to the breech, the second material being proximate to the muzzle, and the material term $\sqrt{E/\rho}$ of the second portion is greater than of the first portion.

6. The electromagnetic launcher according to claim 1, wherein a shape term $\sqrt{I/A}$ of the rail increases along the axial direction.

7. The electromagnetic launcher according to claim 6, wherein the rail comprises first and second cross-section shapes, the first shape being proximate to the breech, the second shape being proximate to the muzzle, and the shape term $\sqrt{I/A}$ of the second shape is greater than of the first shape.

8. The electromagnetic launcher according to claim 7, wherein the first shape is a first rectangular prism having a first height, and the second shape is second rectangular prism having a second height greater than the first height.

9. The electromagnetic launcher according to claim 7, wherein the first shape is a wide rectangular prism, and the second shape is a T-beam.

10. The electromagnetic launcher according to claim 7, wherein the first shape is a wide rectangular prism, and the second shape is a hollow circular arc segment.

11. The electromagnetic launcher according to claim 1, wherein the rail is rigidly connected in tension to the support towards the muzzle.

12. The electromagnetic launcher according to claim 1, wherein a material term k of the support increases along the axial direction.

13. The electromagnetic launcher according to claim 12, wherein the rail comprises first and second materials, the first material being proximate to the breech, the second material being proximate to the muzzle, and the material term k of the second material is greater than of the first material.

14. The electromagnetic launcher according to claim 13, wherein the first material is fiberglass and the second material is ceramic.

15. The electromagnetic launcher according to claim 3, wherein the first and second materials are first and second laminates, respectively.

* * * * *